US008133545B2

(12) United States Patent
Anderson et al.

(10) Patent No.: US 8,133,545 B2
(45) Date of Patent: Mar. 13, 2012

(54) APPARATUS AND METHOD FOR COATING OF ELONGATE FLIMSY MEMBERS

(75) Inventors: Jonathan D. Anderson, Chanhassen, MN (US); Scott D. Schmidt, Mound, MN (US)

(73) Assignee: Harland Medical Systems, Inc., Eden Prairie, MN (US)

( * ) Notice: Subject to any disclaimer, the term of this patent is extended or adjusted under 35 U.S.C. 154(b) by 1359 days.

(21) Appl. No.: 11/726,374

(22) Filed: Mar. 21, 2007

(65) Prior Publication Data

US 2007/0221123 A1 Sep. 27, 2007

Related U.S. Application Data

(60) Provisional application No. 60/784,181, filed on Mar. 21, 2006, provisional application No. 60/784,173, filed on Mar. 21, 2006.

(51) Int. Cl.
*B05D 1/18* (2006.01)
*B05C 3/10* (2006.01)

(52) U.S. Cl. ..... 427/430.1; 427/2.1; 427/2.3; 427/2.28; 427/434.6; 427/434.7; 118/400; 118/423; 118/424

(58) Field of Classification Search ..... 427/2.1, 427/2.3, 2.28, 430.1, 434.6, 434.7, 435; 118/400, 118/423, 424, 429
See application file for complete search history.

(56) References Cited

U.S. PATENT DOCUMENTS 3,539,385 A * 11/1970 Hunter et al. ..... 427/433
5,156,888 A * 10/1992 Haubs et al. ..... 427/163.2
5,344,702 A 9/1994 Haubs et al.
5,693,372 A 12/1997 Mistrater et al.
6,254,921 B1 * 7/2001 Chappa et al. ..... 427/2.3
7,381,273 B2 6/2008 Collins

* cited by examiner

*Primary Examiner* — Timothy Meeks
*Assistant Examiner* — Cachet Sellman
(74) *Attorney, Agent, or Firm* — Patterson Thuente Christensen Pedersen, P.A.

(57) ABSTRACT

A coating apparatus and method for flimsy elongate members has at least one elongate funnel tube with an inlet, an outlet, and an intermediate portion, the inlet in a basin, a fluid circulating system suitable connecting the outlet to provide flow into the inlet. Each inlet receives an elongate flimsy component and utilizes the circulating fluid to pull the flimsy elongate member into the funnel tube whereby the coating of the flimsy elongate member is accomplished. The invention also includes the method for coating such a flimsy elongate member utilizing the coating apparatus.

14 Claims, 2 Drawing Sheets

APPARATUS AND METHOD FOR COATING OF ELONGATE FLIMSY MEMBERS

RELATED APPLICATIONS

This application claims priority to U.S. Provisional Application Ser. No. 60/784,181, filed Mar. 21, 2006 and U.S. Provisional Application Ser. No. 60/784,173, filed Mar. 21, 2006. Both of these applications are incorporated herein by reference.

FIELD OF THE INVENTION

This invention relates to coating equipment, more precisely the invention relates to a method and apparatus for providing coatings on elongate flimsy members that are manufactured into medical devices such as catheters and guide wires.

BACKGROUND OF THE INVENTION

Many medical devices utilize elongate flimsy members that are advantageously coated with various coating including biological coatings. Examples of one of these could be either guide wires or catheters. These items are often up to 100 inches in length and may have a diameter of less than 0.030 inches in diameter. A simple way to coat these flimsy elongate members is to dip them into a solution and then draw them out at a controlled rate. Often, especially for biological coatings, the coating material is so expensive and has such a limited pot life that mixing a large tank of material to dip the device into is cost prohibitive. The standard industry practice is to fill funnel tube with the coating material that is not much larger in diameter than the item to be coated to minimize the volume of fluid. A common funnel tube has an inner diameter of 0.375 inches. A "flimsy" elongate member can, for example, be defined as a member that cannot resist a force of 0.1 pound applied upwardly to the bottom of the member. The flimsy member will buckle rather than resist the force.

There are two basic problems that come up when you try to dip these flimsy elongate members into a funnel tube of coating material. The first problem is the initial insertion of the flimsy elongate member into the funnel tube. The surface tension and the viscosity of the fluid apply oppose the insertion force which can initiate a buckling of the flimsy elongate member. If the buckling is excessive the flexible elongate component will not be urged into the tube and/or the flexible elongate component could be damaged. It is very common for the coating materials to be very viscous(>50 centipose) and have a high surface tension. The most common way to get around this issue is to insert the flimsy elongate member into the funnel tube at a very slow rate (<2 inches/sec) that may allow some level of buckling while the tubing is being inserted. The problem with a very slow dipping rate is that it is slows down the production of these devices to such a slow rate that it is not practical to do this. The problem with allowing some buckling is that it is not very consistent from device to device making it very hard to automate and requiring human intervention.

When inserting these flimsy elongate members into the funnel tube filled with viscous fluid, it is common for the flimsy elongate member to come into contact with the sides of the funnel tube. When the inserted flimsy elongate member does contact the side of the tubing it'd resistance to being inserted into the funnel tube may increase making it more likely to buckle the flimsy elongate member.

SUMMARY OF THE INVENTION

In certain embodiments, a coating apparatus for flimsy elongate members has an elongate coating tube with a funnel shaped inlet portion, an outlet portion, and an intermediate portion, the inlet extending upwardly in a basin, a fluid circulating system connecting the outlet to the basin whereby fluid from the basin flows into the inlet. The inlet also receives the elongate flimsy component and utilizes the circulating fluid to pull the flimsy elongate member into the intermediate portion of the funnel tube whereby the coating of the flimsy elongate member is accomplished. In certain embodiments, a vortex may be created at the inlet portion. Multiple funnel tubes by be utilized the method for coating such a flimsy elongate member utilizing the coating apparatus.

An advantage and feature of certain embodiments of the invention is that the reliability and speed that an automated coating system can process these components is increased. The insertion speed of the elongate flimsy component into the funnel tube is greatly increased.

Another advantage of certain embodiments of the invention is that it allows the flimsy elongate members to be inserted into a small diameter tube filled with fluid without buckling or at much greater rate of insertion without buckling.

Another advantage and feature of certain embodiments is that the feeding mechanism of the elongate flimsy components is simplified and reduced by minimizing the handling difficulty and complexity of the handling mechanisms above the funnel tube. Additional handling apparatus would generally be needed for the insertion motion where the fluid assist is not present.

Another advantage and feature of certain embodiments of the invention is that a plurality or multiplicity of the funnel tubes can be utilized in the basin with the single fluid circulation system providing for batch processing of a large number of elongate flimsy members at one time. This invention allows a medical company manufacturing the devices to maximize its throughput and minimize their costs for coating these devices

DETAILED DESCRIPTION OF THE INVENTION

Figure 1:
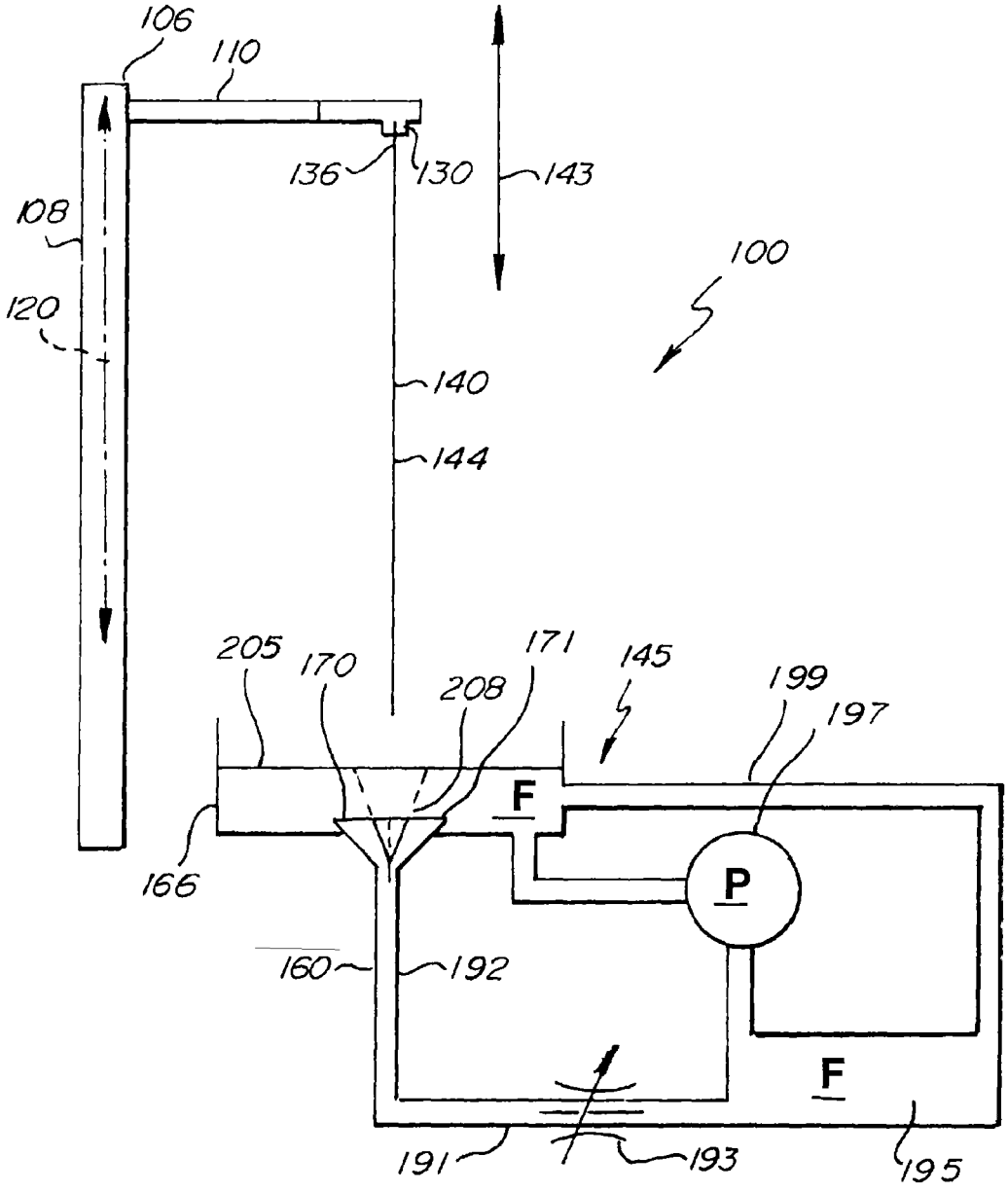
FIG. 1 is a schematic illustration of an embodiment of the apparatus.

FIG. 1 shows an example of the flow directed feeding system 100 for a single funnel tube. A suspension system 106 having support structure 108, a carriage 110 vertically movable with respect to the support structure, and a drive system 120 for moving the carriage. The carriage has a securement portion 130 configured as a clamping device, for example a collet, for securing a first end 136 of the elongate flimsy member 140. A second end 142 and an intermediate portion 144 of the secured elongate flimsy member dangle downwardly therefrom. The carriage moves vertically, as indicated by the arrow 143 for lowering and withdrawing the flimsy elongate member 140 with respect to the fluid circulating system 145 and more specifically the coating tube 160 configured as a funnel tube. The fluid circulating system has the basin 166 or shallow tank with coating fluid F therein. The coating tube 160 has an inlet portion 170 configured as a funnel disposed in the basin and preferably facing upward. The funnel portion has an upper lip 171 over which the fluid in the basin will flow. The coating tube 160 also has an outlet portion 191 with an intermediate portion 192. The funnel tube outlet portion connects to an adjustable flow control valve 193 and leads to a reservoir 195. A circulating pump 197 pumps fluid from the reservoir into the basin. An over flow tube 199 may be utilized to keep the fluid in the basin at a desired level.

When used herein, "portion" can be a discrete part, a combination of a plurality of discrete parts assembled, or an integral portion of a component to which it is part. "Connected", "connecting", and the like do not require direct connection or contact and can have intermediate linking components.

The apparatus operates as follows. First, sufficient fluid in put in the fluid circulating system for plenishing the reservoir, the funnel tube and basin to a desired level. The pump 197 pumps the fluid F from the lower reservoir 195 into the upper reservoir or basin 166. When the fluid level 205 is above the top of the funnel tube 160 it begins to flow down the funnel tube. The flow rate of the pump 197 is preferably greater than the flow down the funnel tube 160 so the level in the upper reservoir 166 increases until it reaches the overflow tube 199 at which point the fluid levels. The flow control value 193 is adjusted to (manually or automatically) to get the fluid to flow down the funnel tube with the right velocity, preferably creating a small vortex 208 at the inlet portion 170 to the funnel tube 160. With the fluid now flowing into the coating tubing 160, a flimsy elongate member can be drawn down and pulled by the fluid into the tube filled with liquid. Once the flimsy elongate member 140 is completely inserted into the tube 160, the flow control valve 193 can be closed and/or the pump shut down. Then the flimsy elongate member 140 will be drawn out of the fluid by the carriage 110 at a controlled suitable rate. This allows the flimsy elongate member 140 to be uniformly coated by the fluid. The level of the liquid in the basin could be controlled by other techniques other than an overflow tube.

Figure 2:
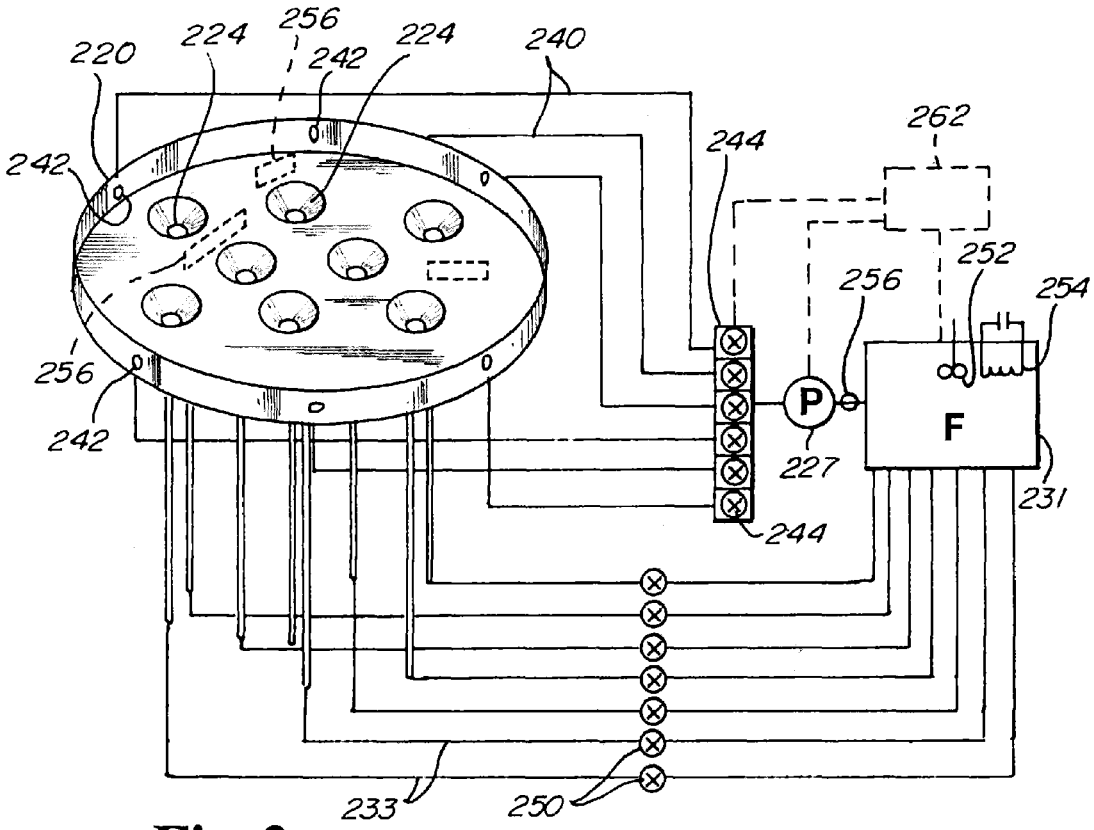
FIG. 2 is a perspective-schematic view of an embodiment illustrating a basin according to the invention herein.

Referring to FIG. 2, an example of multiple fluid flow arrangement includes a basin 220 with a plurality of funnel tube inlets 224 that connect to a fluid reservoir 231 through funnel tube outlet lines 233. A pump 227 circulates fluid back to the basin through inlet lines 240 into basin inlets 242. Control valves 244 may be placed in the inlet lines for regulating flow into the basin. Such valve may be adjustable to provide suitable flow into the individual funnel tube inlets. Similarly, further control valves 250 may be placed in the funnel tube outlet lines 233. Fluid conditioning equipment such as agitators 252, heaters 254, filters 256, and the like may be incorporated as appropriate. A control processor 262 may be utilized to operate the valves and pump and conditioning equipment as well as monitoring the process through various sensors.

Figure 3:
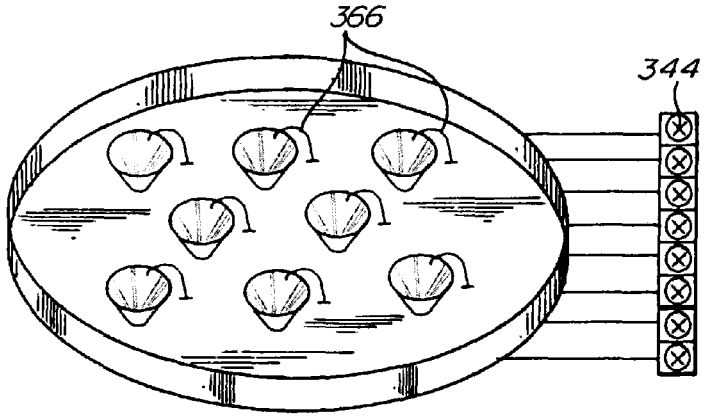
FIG. 3 is a perspective-schematic view of an embodiment illustrating a basin according to the invention herein.

Referring to FIG. 3, an alternative arrangement is illustrated where individual flow lines 366 for each funnel tube inlet are provided with valve controls 344. In this embodiment, the basin may not be required or may be used as an overflow collection basin.

Referring to FIGS. 2 and 3, means for adjusting the inlet flow of the fluid into the funnel tube inlets for creating suitable inlet flow, such as vortexes, includes the control valves 250, 344. Additionally, barriers 256 can be installed, preferably removable, in the basin for tweaking individual inlet flows. Such means for adjusting inlet flow into the funnel tubes can provide the adjustment needed when different coating fluids are utilized with the basin. Such different coating fluids will typically have different flow characteristics requiring some adjustment to obtain ideal fluid flow, such as vortexes in the funnel tube inlets. Various methods can be come with to control the flow of the liquid through the system as part of the means for adjusting the inlet flow including multiple and variable flow pumps. The fluid circulation can have provisions for circulating, for example sequentially, different fluids for step coating of the elongate flimsy member. Also, the fluid utilized during the initial circulation when the elongate flimsy member is drawn into the coating tube does not have to be the ultimate coating fluid utilized for coating the drawn-in elongate flimsy member.

The carriage or controlled motion axis can be made out of any number of computer controlled devices (pc, PLC, motion card, amplifier, power supply, servo motor, stepper, etc.) and the actual motion can be made by many types of drives 120 (belt drive, ball screw, linear motor, etc.).

This invention provides coating of flimsy elongate members in large batches, insertion of the members into a fluid reservoir at a high rate of speed and with great reliability. Typically, the devices being coated are used in the medical industry and are components commonly referred to as guide wires, and catheters.

The above embodiments are intended to be illustrative and not limiting. Additional embodiments are within the claims. Although the present invention has been described with reference to particular embodiments, workers skilled in the art will recognize that changes may be made in form in detail with departing from the spirit and scope of the invention.

We claim:

1. A method of insertion of elongate flexible members into a coating tube, the elongate flexible members each having a first end, an opposite second end, and an intermediate portion, the method comprising:

providing fluid circulation to a coating tube, the coating tube having an inlet and a subordinate portion positioned below the inlet, the fluid circulation entering the inlet and flowing through the subordinate portion, insertion of the second end of an elongate flexible member into the inlet, and providing sufficient fluid flow into the inlet to provide a bias for drawing the elongate flexible member into said coating tube.

2. The method of claim 1 further comprising suspending the elongate flimsy member by the first end connecting to drive system and controlling the draw of the elongate flexible member into the coating tube by controlling the drive system.

3. The method of claim 2 further comprising utilizing a control processor for controlling the drive system.

4. The method of claim 2 further comprising utilizing a control processor for controlling the fluid flow.

5. The method of claim 1 wherein the coating tube has an upwardly facing funnel at the inlet of said coating tube, and the method further comprising insertion of the second end of the flimsy member into said funnel.

6. The method of claim 1 further comprising forming a fluid vortex in the fluid circulation system before the elongate flimsy member is inserted therein.

7. The method of claim 1 further comprising providing fluid circulation to a plurality of coating tubes, the coating tubes each having an inlet and a subordinate portion positioned below the inlet, the fluid circulation entering each of the inlets and flowing through the subordinate portion.

8. A method of insertion of elongate flimsy members into coating tubes for coating said elongate flimsy members, the method comprising forming a fluid vortex at an inlet of said coating tubes and utilizing the vortex to draw the elongate flimsy member into said coating tube.

9. The method of claim 8 further comprising suspending the elongate flexible members above the inlet of said coating tubes and controlling the insertion of the elongate flimsy members into the inlet so as to optimize the insertion rate while preventing buckling of the elongate flimsy member.

10. The method of claim 9 further comprising forming a vortex at a plurality of inlets of a plurality of coating tubes and simultaneously inserting a plurality of elongate flimsy members into the plurality of inlets.

11. A method of insertion of a plurality of elongate flimsy members into a coating portion of process equipment, the method comprising creating a plurality of vortexes in a plurality of inlets configured as funnels, and simultaneously lowering the plurality of elongate flimsy members into the inlets.

12. The method of claim 11 further comprising controlling the lowering of the elongate flimsy members into the plurality of vortexes by a control processor to minimize buckling of the elongate flimsy members during the lowering.

13. A method of coating elongate flexible members, the elongate flexible members each having a first end, an opposite second end, and an intermediate portion, the method comprising:

providing a fluid circulation system having an inlet and a subordinate portion positioned below the inlet, portion, circulating the coating fluid into the inlet and flowing through the subordinate portion thereby providing a bias for drawing the elongate flexible member into said inlet, and insertion of the first end of the elongate flexible member into the inlet whereby the bias draws the first end into the intermediate portion.

14. The method of claim 13 further comprising forming a fluid vortex by the fluid circulation system, the vortex positioned at the inlet.

* * * * *